United States Patent [19]

Hunt

[11] 4,224,364

[45] Sep. 23, 1980

[54] ORNAMENTAL DISPLAY CONTAINER

[76] Inventor: Bettie W. Hunt, 5217 Carmel Park Dr., Charlotte, N.C. 28211

[21] Appl. No.: 968,294

[22] Filed: Dec. 11, 1978

Related U.S. Application Data

[63] Continuation-in-part of Ser. No. 935,582, Aug. 21, 1978, abandoned.

[51] Int. Cl.[2] ..... A47G 33/08

[52] U.S. Cl. ..... 428/11; 40/152; 40/617

[58] Field of Search ..... 40/152, 152.2, 152.1, 40/540, 617; 63/18, 19; 428/11, 13, 14; 206/575; 29/463, 469

[56] References Cited

U.S. PATENT DOCUMENTS

| | | | |
|---|---|---|---|
| 490,902 | 1/1893 | Galbreath | 428/11 X |
| 2,742,725 | 4/1956 | Esposito | 428/11 X |
| 3,694,648 | 9/1972 | Yates | 428/11 |
| 3,940,521 | 2/1976 | Hack | 428/11 |
| 4,173,667 | 11/1979 | Rusch | 40/617 X |

FOREIGN PATENT DOCUMENTS

| | | | |
|---|---|---|---|
| 1404803 | 5/1969 | Fed. Rep. of Germany | 428/11 |
| 2803512 | 11/1978 | Fed. Rep. of Germany | 40/152 |

*Primary Examiner*—John F. Pitrelli
*Attorney, Agent, or Firm*—Clifton T. Hunt, Jr.

[57] ABSTRACT

An ornamental display container comprising a pair of hollow housing sections and a connecting ring for releasably joining the housing sections together to define a closed container. In one embodiment of the invention the assembled housing is a ball and the connecting ring comprises a circular rib with opposed outwardly extending flanges extending from opposite sides of the rib to frictionally receive and retain the housing sections. An inner portion of the rib projects inwardly from the flanges to define an annular support for two and three dimensional objects selectively displayed on the annular support.

11 Claims, 17 Drawing Figures

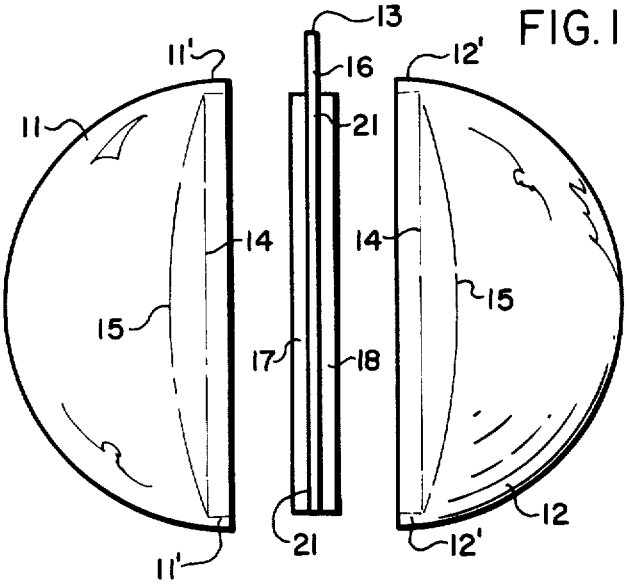
FIG. 11
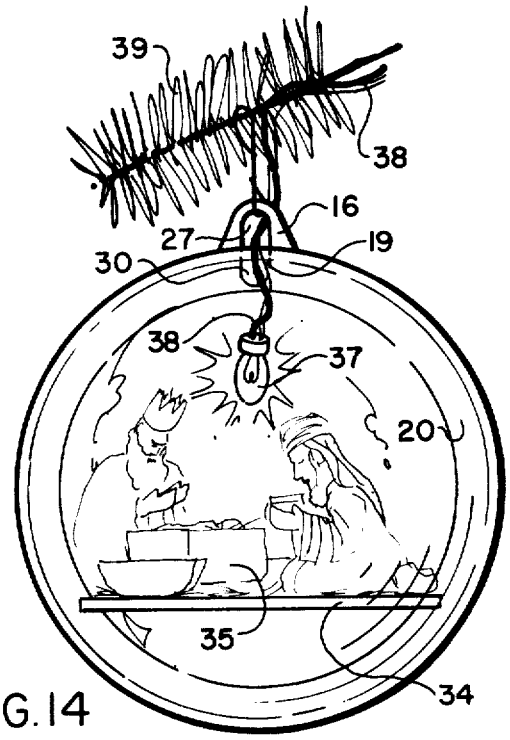
FIG. 14
FIG. 13
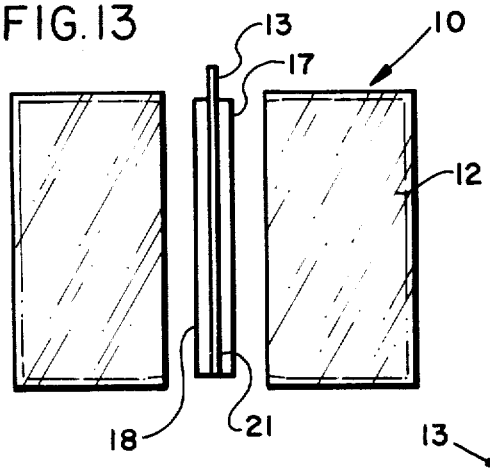
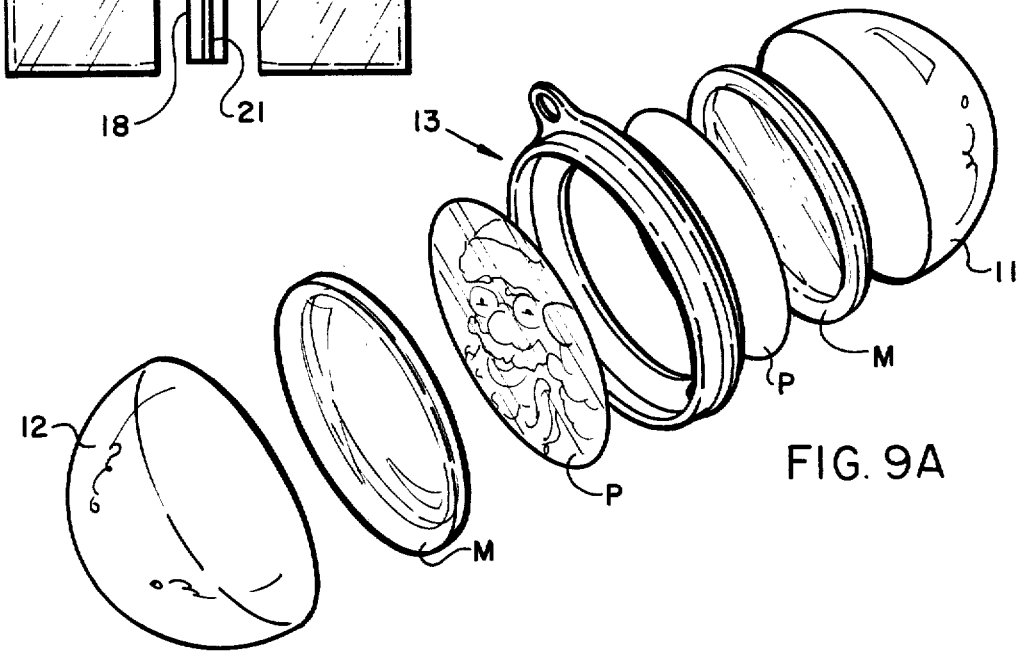
FIG. 9A

ORNAMENTAL DISPLAY CONTAINER

CROSS-REFERENCE TO RELATED APPLICATION

This application is a continuation-in-part of my copending application Ser. No. 935,582, filed Aug. 21, 1978 now abandoned.

BACKGROUND OF THE INVENTION

Ornamental display devices have long been known for displaying pictures and three dimensional objects. To applicant's knowledge, ornamental display devices of the prior art are constructed to display either pictures or other two dimensional objects, or they are arranged to display three dimensional objects. Applicant has no knowledge of any ornamental display container in the prior art that selectively displays either a two dimensional object, such as a picture, or a three dimensional object, such as a toy figurine, at the option of the user.

Heretofore, picture frames have been known of many constructions but they are arranged to exhibit only two dimensional objects. Display cases for exhibiting three dimensional objects are usually large stationary containers such as the glass walled containers for counters in department stores and museums. Portable containers are also known for exhibiting small objects, such as jewelry, but none of these prior art containers combine the ability to selectively display either a two dimensional object or a three dimensional object within the same container at the option of the user.

The ornamental display container of this invention may be used as a convenient and attractive package. In its preferred form it is made of virtually unbreakable plastic which may be transparent or opaque as desired. A transparent container made in accordance with the invention has been successfully sent through the United States Postal System as ordinary first class mail without any wrapping or packaging. It has come to applicant's attention, subsequent to the present invention, that General Electric Company was offering in October, 1978 what it calls a personalized photo ornament kit comprising two hemispheres releasably attached together in overlapping relation along their equatorial edges. A neck portion is formed integral with the hemispheres and supports inwardly extending posts which abut each other when the hemispheres are clamped together to releasably support a relatively rigid backing to which a desired photograph is adhesively attached for display. There is no suggestion of using the General Electric kit for the display of three dimensional objects and the General Electric container is not usable as a package, being subject to breakage.

SUMMARY OF THE INVENTION

The present invention relates to a portable ornamental display container of transparent light weight construction which is adapted to be supported as on a Christmas tree, or which may be supported for display on a support stand beneath the display container. In its preferred form the ornamental display container of the present invention is globular or ball shaped, but it may be square, rectangular, oblong or any desired configuration. Similarly, the ornamental display container of the present invention may be of any desired size. In the illustrated embodiment the ornamental display container is the size of a conventional Christmas ornament, such as three inches in diameter.

It is an object of the invention to provide an ornamental display container which may be selectively used to display a two dimensional or a three dimensional object.

It is a more specific object of the invention to provide an ornamental display container of the type described comprising a pair of transparent housing sections and a connecting ring including means for releasable attachment of the housing sections to opposite sides of the connecting ring.

It is a further object of the invention to provide a device of the type described wherein the connecting ring comprises an annular rib having an inner portion and an outer portion defined by oppositely directed flanges extending in perpendicular relation from opposed surfaces of the rib.

A further object of the invention is to provide a device of the type described wherein the housing sections are hemispheres and the equatorial edges of the hemispheres are frictionally fit against the flanges of the ring to releasably retain the hemispheres and ring in assembled relation to define a hollow ball.

According to the invention the inner portion of the rib defines an annular seat to releasably support the marginal edges of two dimensional objects such as pictures. The pictures or the like to be displayed are mounted in back-to-back relation on opposite sides of the annular seat and within the connecting flange extending perpendicularly from the rib. Adhesive may be used to attach the two dimensional objects to the annular seat or the objects to be displayed may be retained by a frictional fit against the flange.

The annular seat includes means for supporting three dimensional objects for display within the hollow transparent ball. Such means may comprise a hole extending through the annular seat through which a string may be passed to support any desired three dimensional object, such as a wedding ring.

Alternatively, three dimensional objects such as currency or figurines may be displayed within the ball without support; or, a platform may be supported by the annular ring and the three dimensional object to be displayed mounted on the platform within the ball.

Means for supporting the assembled ball are formed integral with the connecting ring, said means preferably including an ear or tab projecting from the rib and having a hole therethrough through which a supporting wire or string may be passed preparatory to connecting it to a suitable support, such as a bracket or Christmas tree.

The hemispheres or housing sections and the connecting ring which comprise the novel ball or container of the present invention are preferably made from a tough durable plastic such as a polycarbonate sold under the trademark LEXAN by General Electric Company. When so made the container makes an attractive and useful package which may be sent through the mail without any wrapping or other packaging.

According to a modified form of the invention the hollow hemispheres are replaced with solid or semi-solid hemispheres of transparent material. The solid hemispheres are joined together in spaced relation along their flat surfaces and two dimensional objects are positioned between the solid hemispheres for display. The displayed images are magnified by the configuration of the transparent hemispheres, making it possible to make an effective display of a small picture. Three dimensional objects can be displayed by hollowing out the inner portions of the hemispheres while still leaving a sufficient solid portion to provide the desired magnification.

The solid magnification hemispheres preferably have annular rims projecting from their flat surfaces for engagement with the flanges of the connecting ring so that the hemispheres may be separated preparatory to mounting a two-dimensional object for display on the annular seat. Alternatively, magnification can be obtained using hollow hemispheres by providing a separate magnifying glass spaced in front of the displayed object within the assembled container.

BRIEF DESCRIPTION OF THE DRAWINGS

FIG. 9A is a view similar to FIG. 9 but showing magnifying glasses in front of the pictures;

FIG. 11 is an exploded view of the ornamental display container wherein the hemispheres have enthickened portions or are solid to provide magnification to the articles displayed on the connector ring;

FIG. 13 is an exploded view of a container having rectangular housing sections joined by a correspondingly shaped connecting ring; and FIG. 14 is a fragmentary view partially in elevation and partially in section and illustrating an electric light within the container.

DETAILED DESCRIPTION OF THE INVENTION

Figure 1:
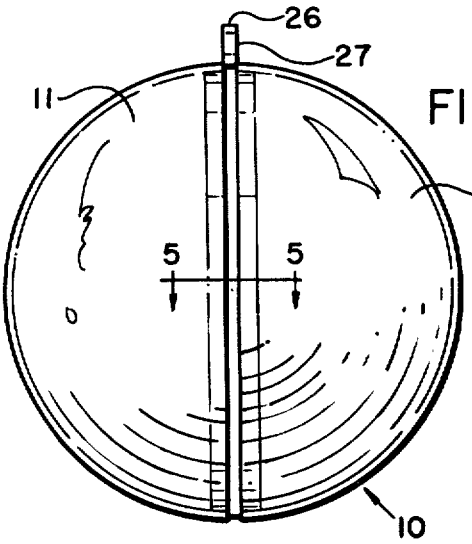
FIG. 1 is a side elevation of the ornamental display container.

Referring more specifically to the drawings, the numeral 10 broadly indicates an ornamental display container comprising a pair of housing sections 11 and 12 and a connector ring generally indicated at 13. The housing sections may be hollow as illustrated in FIGS. 1, 2, 6 and 9, or they may be solid having flat equatorial faces 14 or partially hollowed out as indicated by the dotted lines 15 in FIG. 11.

The hemispheres 11 and 12 are preferably transparent and may be made from glass or any suitable transparent plastic for use as a display container. A satisfactory container has been made, for example, from polycarbonate or LEXAN (a trademark of the General Electric Company) having a wall thickness of about 1/16 of an inch. The assembled container was three inches in diameter. LEXAN has the desirable property of being extremely tough and virtually unbreakable in ordinary use. When made of such durable material the display container has additional utility as a package for delivery of its contents. Of course, one or both of the housing sections may be opaque or translucent, as desired.

The connecting ring 13 comprises a circular rib 16 and annular flanges 17 and 18 extending perpendicularly and in opposed relation to each other from opposite sides of the rib 16. The opposed flanges 17 and 18 define an inner rim portion 20 and an outer rim portion 21. The inner rim portion 20 extends inwardly from its juncture with flanges 17 and 18 a short distance toward the center of the connecting ring and serves as an annular support for the marginal edges of two dimensional display objects such as pictures, for example. Both sides of the annular support 20 may be coated or spotted with a pressure sensitive adhesive to releasably retain the display item in a desired position on the annular support 20.

The equatorial edge portions of the hemispheres 11 and 12 have a reverse taper of about 0.005, for example, so that their end edges are that much thicker to provide a tight frictional fit with respective flanges 17 and 18 to frictionally retain the hemispheres and connecting ring in assembled relation. The outer rim portion 21 serves as a stop against which the enthickened equatorial edges of the hemispheres 11 and 12 rest when assembled on the mounting flanges 17 and 18. The housing sections 11 and 12 may be attached to the connecting ring by any of several known means, such as mating threads on the flanges and edge portions of the hemispheres 11 and 12 or by such other means as desired. The press fit as described has been found satisfactory in use and has the advantage of being usable with housing sections which are rectangular or other than round, and the additional advantage of not visually detracting from the ornamental display.

In the above-described physical embodiment the mounting flanges 17, 18 each extend about ⅛ inch from the rib and the enthickened and reversely tapered equatorial edges of the hemispheres extend inwardly a corresponding dimension to provide a tight fit. The outer rim portion 21 serves to align the hemispheres after they are seated and to provide stability to the assembled container. In some instances the fit is so tight that air pressure within the assembled container exceeds ambient air pressure sufficiently to prevent firm seating of the hemispheres on the mounting flanges. A vent hole 19 (FIG. 14) may be provided to relieve air pressure resulting from pushing together the hemispheres 11 and 12.

Figure 4:
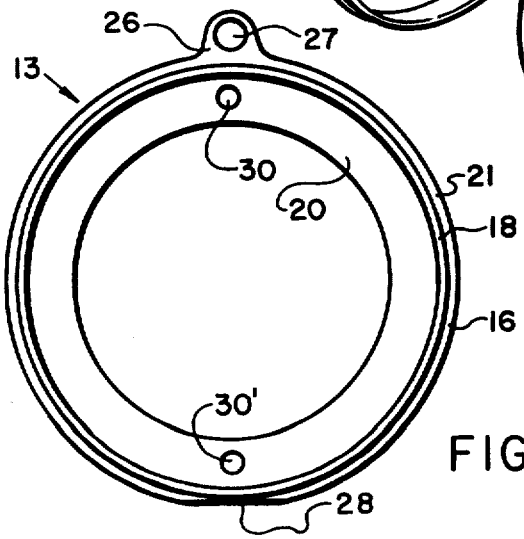
FIG. 4 is a front elevation of the connecting ring removed from the container.
Figure 12:
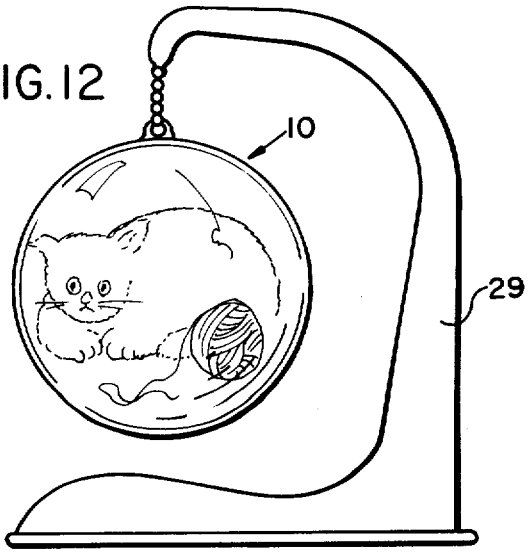
FIG. 12 is a perspective view of the container supported on a desk top bracket.
Figure 5A:
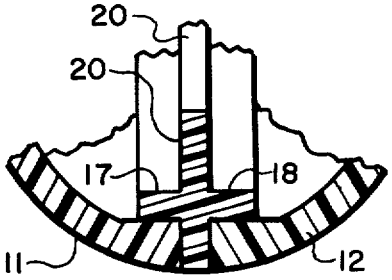
FIG. 5A is an enlarged fragmentary view of the lower portion of FIG. 5 illustrating the reverse taper on the equatorial edges of the hemispheres.

The outer rim portion 21 of ring 13 has formed integral therewith an outwardly projecting tab or ear 26 penetrated by a hole 27 through which a string or wire may be passed to suspend the container from a bracket such as indicated at 29 in FIG. 12 or from any desired structure such as a Christmas tree represented at 39 in FIG. 14. Opposite the tab 26 on the outer rim portion 21 is a flattened surface 28 (FIG. 4) which provides a space between the hemispheres 11 and 12 when assembled to enable a prying device such as a coin or screw driver to be inserted between the hemispheres and pry them apart to gain access to the interior to arrange displays supported by the annular support 20, or otherwise.

Figure 2:
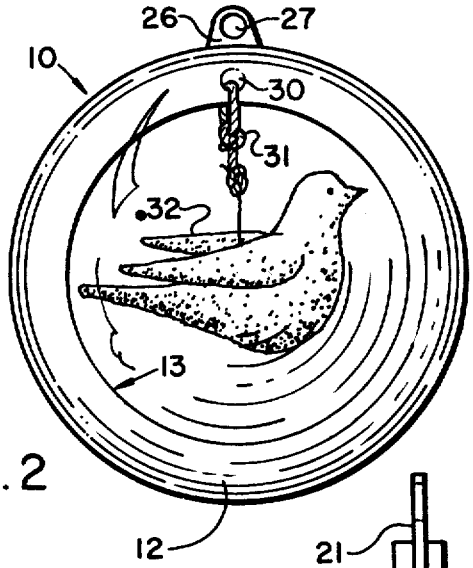
FIG. 2 is a front elevation of the ornamental display container.
Figure 3:
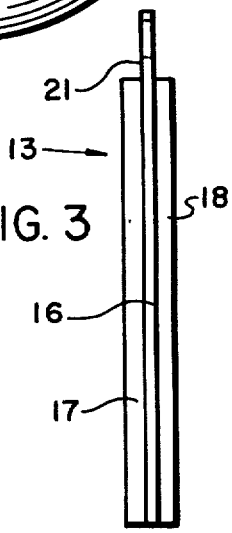
FIG. 3 is a side elevation of the connecting ring removed from the container.
Figure 9:
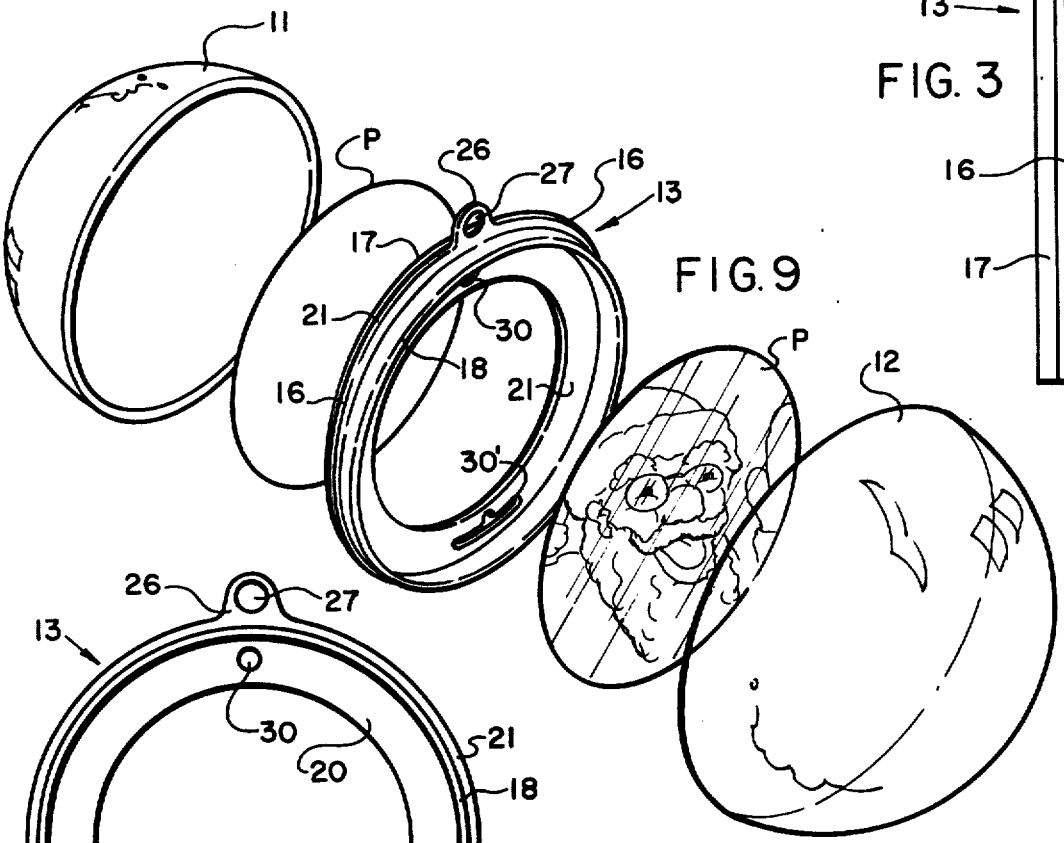
FIG. 9 is an exploded perspective view of the ornamental display container illustrating how pictures are mounted in back-to-back relation on the connecting ring and between the hemispheres.
Figure 10:
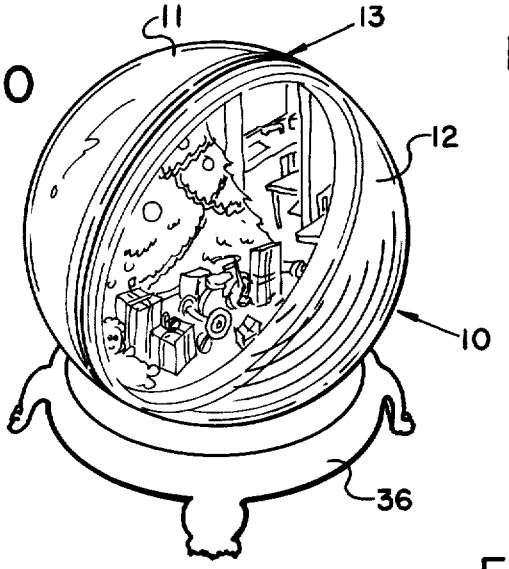
FIG. 10 is a perspective view of the assembled ornamental display container mounted on a support.
Figure 5:
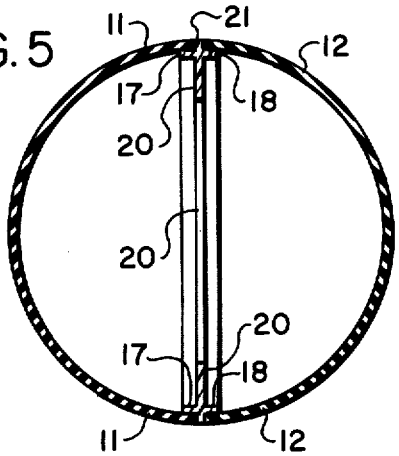
FIG. 5 is a horizontal sectional view taken substantially along the line 5—5 in FIG. 1.
Figure 7:
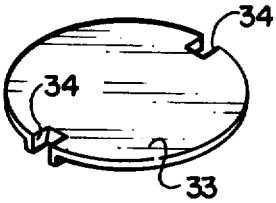
FIG. 7 is a perspective view of the platform removed from the container.
Figure 7A:
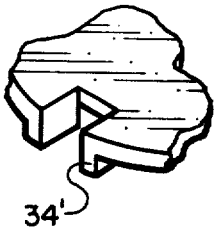
FIG. 7A is an enlarged fragmentary view of the left side of FIG. 7 and illustrating the enthickened opposed edges of the slot.
Figure 6:
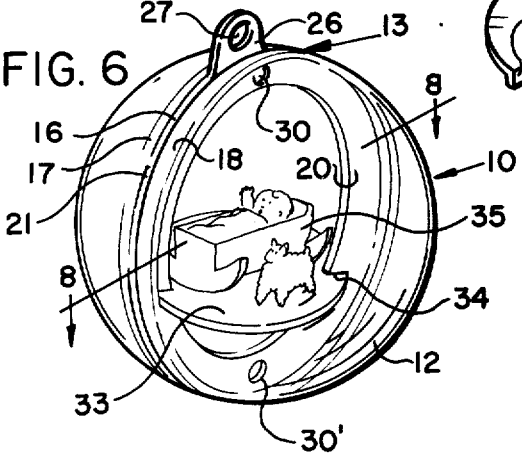
FIG. 6 is a perspective view of the container illustrating a platform supported by the connecting ring for display of three dimensional objects.
Figure 8:
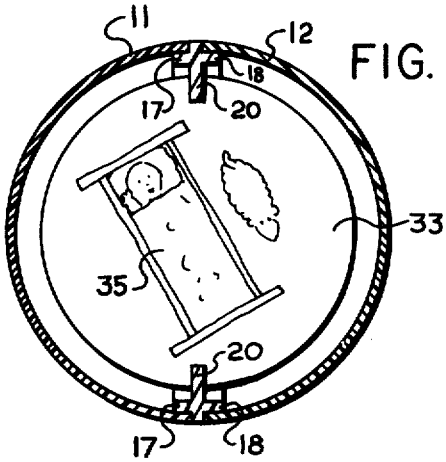
FIG. 8 is a horizontal sectional view taken substantially along the line 8—8 in FIG. 6.

Annular support 20 has a hole 30 through which a wire, string or ribbon 31 may be passed to support a three dimensional object such as a model of an airplane or bird 32 (FIG. 2). FIGS. 6–8 illustrate a platform 33 notched as at 34 on opposite sides to fit around annular support 20 beneath its horizontal diameter in use. The diameter of platform 33 is less than the inner diameter of annular support 20 so the platform may be passed through the annular support and lowered until the notches 34 fit around the support 20 beneath its center. Figurines 35 may be mounted on the platform 33 for display within the container 10. FIG. 10 illustrates that the container 10 may be supported from beneath as by a stand or table 36. The container is preferably rotated so the tab 26 is hidden by the support 36. The hole 30 is provided in support 20 opposite hole 30 to support a three dimensional object when the container 10 is rotated to be supported from beneath as in FIG. 10.

Referring to FIG. 11, the hemispheres 11 and 12 are illustrated as being formed from substantially solid transparent material such as glass or an acrylic polymer and having flat equatorial surfaces 14 or, if desired, the hollowed out to provide space for the display of three dimensional objects in the manner previously described. The hemispheres 11 and 12 are assembled on the connecting ring 13 by annular rims 11' and 12' in FIG. 8. The rims 11' and 12' project beyond the equatorial surfaces of respective hemispheres 11 and 12 and are enthickened and tapered in the manner previously described in connection with the equatorial end portions of the hollow hemispheres 11 and 12 in FIGS. 1, 2, 6 and 9.

The articles displayed within the ornamental display container of FIG. 7 are magnified when viewed through the partially solid hemispheres 11 and 12 thereby providing an added dimension to the viewing pleasure. Magnification may also be obtained by providing a magnifying glass M in front of each picture P inside of each hollow hemisphere 11 and 12 (FIG. 9A).

The vent 19 in FIG. 14 provides a convenient passageway for an electric wire 38 to provide current to a light 37 within container 10 to illuminate a display 35 or other contents of the container 10 as desired (FIG. 14).

There is thus provided an improved ornamental display container which will provide opportunities for effectively displaying either two dimensional or three dimensional objects as the user desires.

Although specific terms have been used in the specification and drawings they are used in a descriptive sense only and not for purposes of limitation.

I claim:

1. In a display container having first and second housing sections, at least one of which is transparent, the combination of an improved connecting ring having an axis and comprising oppositely directed annular flanges extending in parallel relation to the axis of the ring and in opposed relation to each other from opposite sides of the ring, each housing section including an edge portion shaped to frictionally overlie one of said annular flanges, and an inner rim extending radially inwardly from said annular flanges and terminating in spaced relation to the axis of the ring to define an opening between the housing sections, whereby the inner rim provides annular support for two-dimensional objects displayed within the container and defines space between the housing sections to display three-dimensional objects.

2. A display container according to claim 1 wherein said inner rim has at least one hole therethrough for the reception of a fastener to support in object for display within the container.

3. A container according to claim 1 wherein a platform is provided in the container for the display of articles, and said platform having opposed notches which are registrable with the inner rim for support of the platform.

4. A display container according to claim 1 and including an outer rim joined to said annular flanges and extending radially outwardly in opposed relation to said inner rim, and said outer rim serving as a stop against which the edges of the housing sections abut when assembled on respective annular flanges.

5. A display container according to claim 4 wherein said outer rim includes an outwardly projecting tab having a hole for support of the container.

6. A display container according to claim 4 wherein one portion of the outer rim is flattened to define a space between the housing sections when assembled, whereby a prying device may be inserted between the housing sections to pry them apart.

7. A container according to claim 1 wherein a light is disposed in the container and connected to a source of energy.

8. A container according to claim 1 wherein at least one of said housing sections is transparent and shaped to magnify the contents of the container.

9. A container according to claim 1 wherein a magnifying glass is supported between the transparent housing section and the displayed item.

10. A container according to claim 9 wherein a light is disposed in the container and connected to a source of energy.

11. A container according to claim 1 wherein the housing sections are of rectangular cross-sectional configuration.

* * * * *